US007596820B2

(12) United States Patent
Nielsen et al.

(10) Patent No.: US 7,596,820 B2
(45) Date of Patent: Oct. 6, 2009

(54) LINEAR ACTUATOR FOR BEDS, SLATTED BEDS OR CHAIRS

(75) Inventors: Jens J. Nielsen, Broager (DK); Norbert Klinke, Augustenborg (DK)

(73) Assignee: Linak A/S, Nordborg (DK)

( * ) Notice: Subject to any disclaimer, the term of this patent is extended or adjusted under 35 U.S.C. 154(b) by 386 days.

(21) Appl. No.: 11/629,988

(22) PCT Filed: Jun. 21, 2005

(86) PCT No.: PCT/DK2005/000416

§ 371 (c)(1),
(2), (4) Date: Dec. 21, 2006

(87) PCT Pub. No.: WO2005/122840

PCT Pub. Date: Dec. 29, 2005

(65) Prior Publication Data

US 2008/0271246 A1 Nov. 6, 2008

(30) Foreign Application Priority Data

Jun. 21, 2004 (DK) ..... 2004 00971

(51) Int. Cl.
*A61G 7/015* (2006.01)
*A61G 7/05* (2006.01)

(52) U.S. Cl. ..... 5/618; 5/616; 297/69; 297/362.14; 318/467

(58) Field of Classification Search ..... 5/618, 5/616; 297/69, 85 M, 362.14; 318/467
See application file for complete search history.

(56) References Cited

U.S. PATENT DOCUMENTS

| | | | |
|---|---|---|---|
| 1,695,772 | A | 12/1928 | Mingle et al. |
| 3,059,248 | A | 10/1962 | Wetzler |
| 7,009,353 | B2 | 3/2006 | Dewert |
| 2004/0015320 | A1 | 1/2004 | Nagaoka et al. |

FOREIGN PATENT DOCUMENTS

| | | |
|---|---|---|
| DE | 19654110 | 1/1998 |

OTHER PUBLICATIONS

English Abstract of DE 19654110.

*Primary Examiner*—Alexander Grosz
(74) *Attorney, Agent, or Firm*—Dykema Gossett PLLC

(57) ABSTRACT

An actuator for beds, slatted beds or chairs of the type accommodating, in a cabinet, two drive units based on a spindle and a spindle nut configured as an adjustment element, cooperating with an arm of a rotary shaft for a backrest section and a legrest section, respectively, in the bed, the mattress support or the chair. The two spindles are rotational interconnected and are driven by a common reversible electric motor. By having just one motor and one transmissions, as well as no switching mechanism between the two spindles, a simple and inexpensive structure is provided.

11 Claims, 3 Drawing Sheets

LINEAR ACTUATOR FOR BEDS, SLATTED BEDS OR CHAIRS

BACKGROUND OF THE INVENTION

1. Field of the Invention

The present invention relates to a linear actuator for beds, slatted beds or chairs and to a bed, a mattress support or a chair which includes the linear actuator.

2. The Prior Art

Adjustment of backrest and legrest sections of beds on the basis of electric motors has been well-known for years with respect to hospital and nursing beds. The implementation in beds for domestic use gathered momentum only with the development of the type of actuators which is described in, e.g., WO 89/10715 to Dewert Antriebs- und Systemtechnik and DE 38 42 078 to Dietmar Koch. These actuators are based on two individual drive mechanisms driven by their respective electric motors and mounted separately at their respective ends of a common cabinet.

The structure disclosed in WO 03/055359 to Cimosys departs from the idea of having a motor for each drive mechanism. Here, there is a common motor with coupling mechanisms so that the one or the other spindle, respectively, may be driven. However, there are still two fundamentally identical, separate drive mechanisms.

The object of the invention is to provide a structure of these actuators which may create the basis for a single and inexpensive product.

SUMMARY OF THE INVENTION

This is achieved according to the invention in that the two spindles are rotational interconnected and are driven by a common motor. The invention thus departs from the idea that this form of actuator must necessarily have two separate drive units. In addition to having just one motor, also a simpler motor is ensured in that only one motor is to be controlled, and the manual control is correspondingly simple.

The spindles may either be made in one piece or alternatively as two separate spindles which are connected non-rotatably with each other. The spindles may be made in one piece of a rod, with spindle threads provided at each end on the desired extent. A particularly simple connection of two separate spindles may be a pipe member or a rod. Of course, the connection may also be formed by a gear wheel transmission, which makes it possible to achieve different speeds of the spindles and thereby different adjustment speeds of the backrest and legrest sections. A gear wheel transmission, however, is more expensive than a simple pipe or rod connection.

The threads of the spindle unit may have the same direction, right-hand or left-hand threads at each end, whereby the spindle nuts will move in the same direction. Alternatively, the direction of the threads may be different, e.g. right-hand threads at one end and left-hand threads at the other end. Other things being equal, the latter provides for a shorter spindle and also allows the shorter spindle to be under tension.

In the previously known structures mentioned above, a worm gear is typically used, wherein the motor is disposed perpendicularly to the spindle shaft. This is a well-tested structure, which may also be used in connection with the invention. With the invention, it may be attractive to use an in-line solution, i.e., with the motor in extension of the spindle axes. This results in a long, slender cabinet without laterally protruding motor.

It has been found expedient that both spindles are loaded for tension, whereby column effect may be ignored.

The spindle of the backrest section has a greater pitch than the spindle of the legrest section. This gives a more rapid adjustment of the backrest section relative to the legrest section, which, seen from a user's point of view, is attractive. An expedient pitch of the spindle of the backrest section is of the order of 2½ mm, while the pitch of the spindle of the legrest section is of the order of 2 mm. It is observed for the sake of good order that the different adjustment speeds of the backrest and legrest sections may also be achieved in a transmission between these and the actuator, typically with arms and carrier rods of different lengths.

The pattern of movements of the backrest and legrest sections are related because of the connected spindles, but, in spite of this, the pattern of movement may be adapted within certain limits by an expedient configuration of the actuator. An expedient pattern of movement is where the spindle nuts are adjusted such that the backrest section may be raised from a horizontal position to a predetermined angle before the legrest section is activated for raising from its horizontal position. This means that the user may choose to raise the backrest section to a certain degree without the legrest section following. It has been found expedient to be able to raise the backrest section to an angular position of the order of 15° before the legrest section is activated. It has been found expedient that the backrest section may be raised to a maximum angular position of the order of 65° and the legrest section to a maximum angular position of the order of 35°. Movement of the legrest section simultaneously with the backrest section counteracts forward sliding of the user in the bed.

The invention includes a bed or a mattress support with a backrest section and a legrest section, each with a transverse rotary shaft with an arm, wherein the sections may be raised and lowered by rotation about their respective shafts, and wherein the movements are performed with an actuator as discussed above.

Further features of the invention will appear from the following embodiment of the invention, which will be described more fully below with reference to the accompanying drawing.

DETAILED DESCRIPTION OF THE PREFERRED EMBODIMENTS

Figure 1:
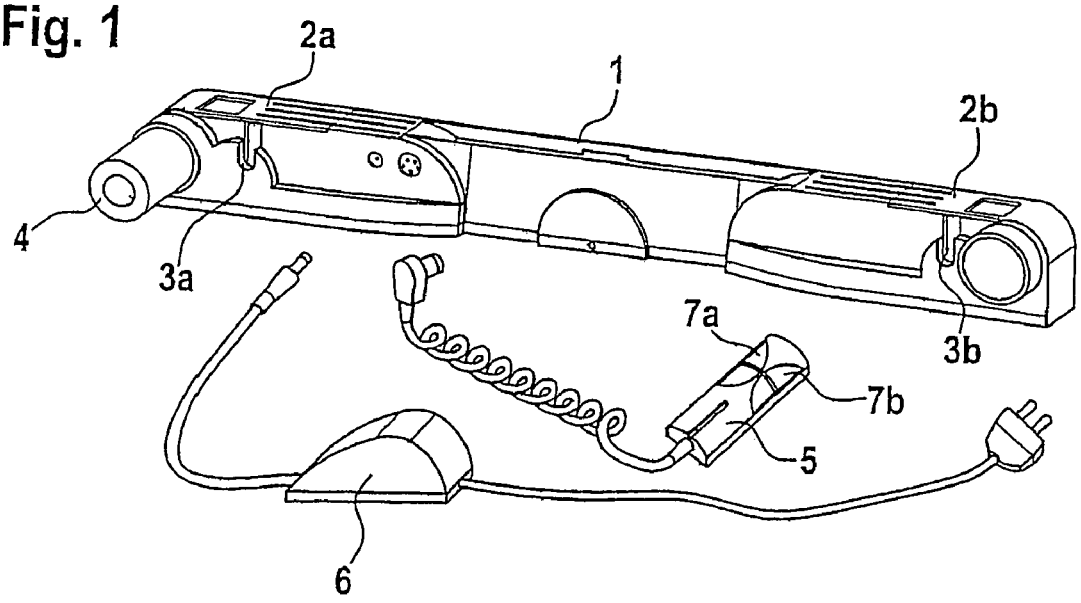
FIG. 1 shows a perspective view of an actuator according to the invention.

As will appear from FIG. 1 of the drawings, the actuator includes an elongate cabinet 1 with a cover 2*a*, 2*b* which is displaceable from the ends and gives access to a transverse shaft opening 3*a*, 3*b*. At one end of the cabinet, the motor is provided in a motor housing 4 arranged perpendicularly from the cabinet. The cabinet has ports for the connection of a hand control 5 and a transformer 6. Owing to its simple structure, the hand control need only be equipped with two operating keys 7*a*, 7*b*, viz. one for effecting the raising function and one for the lowering section. The control may also be simplified by allowing the motor current to pass through the hand control in contrast to more sophisticated controls where a separate lower control voltage is used.

Figure 2:
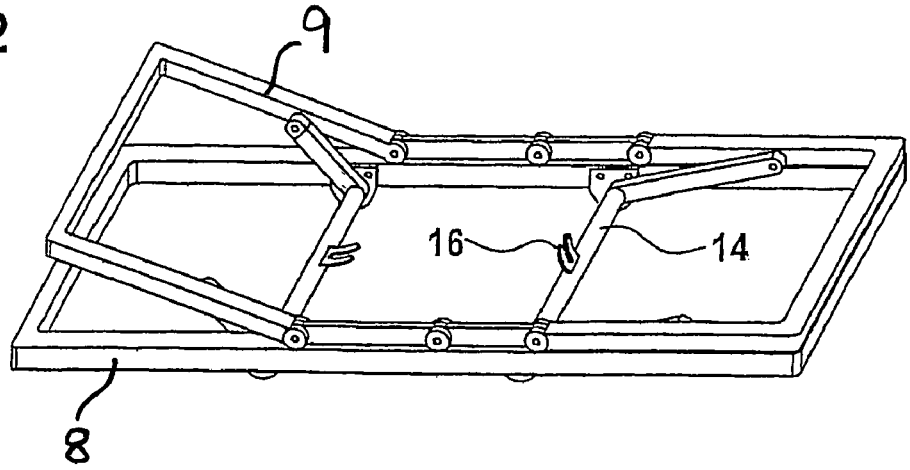
FIG. 2 shows a mattress support with raised backrest section.
Figure 3:
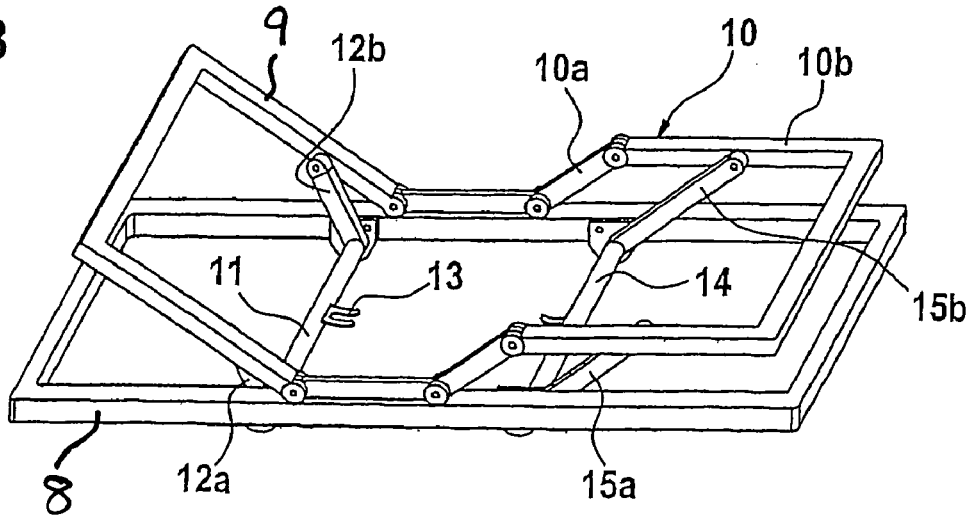
FIG. 3 shows the mattress support with raised backrest and legrest sections.

As will appear from FIGS. 2 and 3, the mattress support includes an circumferential frame 8 which mounts a backrest section 9 and a legrest section 10 which are articulated 10*a*, 10*b*. A transverse shaft 11 with a rod 12*a*, 12*b* at each side is mounted in the frame for the backrest section 9. A small arm 13 is secured on the shaft. Correspondingly, there is a shaft 14 for the legrest section 10 with rods 15*a*, 15*b*, just as a small arm 16 is provided on the shaft.

The actuator is mounted on the mattress support by pulling out the covers 2*a*, 2*b* and moving the actuator up until the shafts 11, 14 rest in the openings 3*a*, 3*b*. The covers are closed again, whereby the actuator hangs on the shafts 11, 14.

Figure 4:
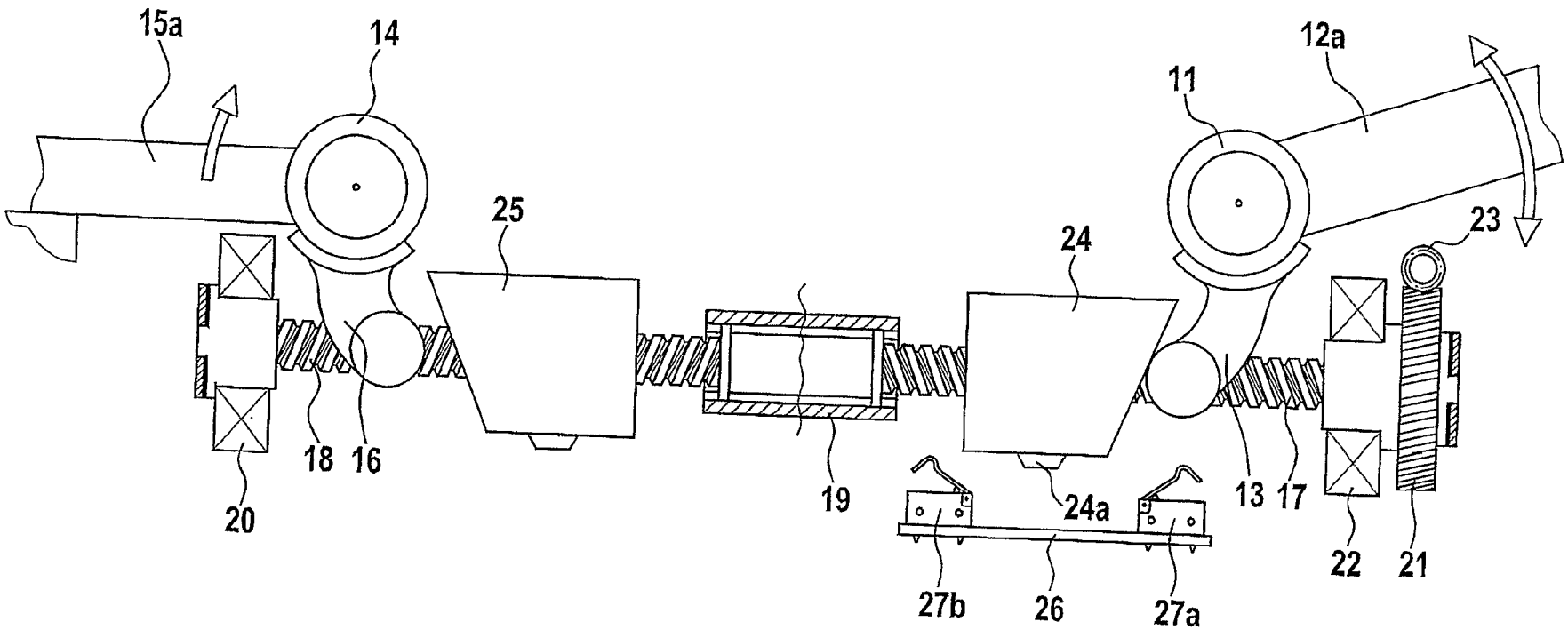
FIG. 4 shows a basic sketch of the drive mechanism of the actuator.

As will appear from FIG. 4, the cabinet accommodates a spindle unit formed of a spindle 17 with right-hand threads and a spindle 18 with left-hand threads. The spindles 17, 18 are firmly connected with each other by a small pipe member 19. The end of the spindles has welded thereto a small star-shaped plate member, which is in turn welded to the pipe member. A tension bearing 20 is secured on the other end of the spindle 18. A worm wheel 21 is secured to the other end of the spindle 17, where also a second tension bearing 22 is provided. The worm wheel 21 is in engagement with a worm 23 configured as an extension of the motor shaft.

Each spindle 17, 18 has a spindle nut 24, 25 configured as an adjustment element with an inclined end for engagement with respective arms 13, 16 on the shafts of the backrest and legrest sections. The arms are double so that they straddle the spindles. The spindle nuts 24, 25 are shaped as four-edged blocks with a through hole with internal threads for the respective spindles and are secured against rotation by guides provided in the cabinet.

The nuts 24, 25 are so arranged on the spindles 17, 18 that the nut 24 for the backrest section moves from a parking position retracted toward the centre out to engage the arm 13, while the nut for the legrest section is still not in contact with its arm 16. Thus, the backrest section may move between 0° and 15° without the legrest section being lifted, as illustrated in FIG. 2. Only when the backrest section has been lifted to an angular position of 15°, will the nut 25 engage the arm 16, whereby the legrest section begins to raise. From the 15°, the backrest section may be rotated additionally to its maximally raised position of 65°, while the legrest section simultaneously raises from 0° to maximum 35°, as illustrated in FIG. 3. The different speeds of the backrest and legrest sections are caused in that the spindle of the backrest section has a pitch of 2½ mm, while the spindle of the legrest section just has a pitch of 2 mm.

As an alternative to the foregoing, the spindle nuts may be adjusted such that the legrest section is raised first from a horizontal position to a predetermined angle before the backrest section is activated for raising from its horizontal position.

The outer positions of the backrest and legrest sections are determined by an end stop print 26 with end stop switches 27*a*, 27*b* which are arranged immediately below the nut 24 and are activated by a boss 24*a* on it. It is a further advantage of the invention that a single end stop print suffices, since the legrest section follows the backrest section as a slave.

Figure 5:
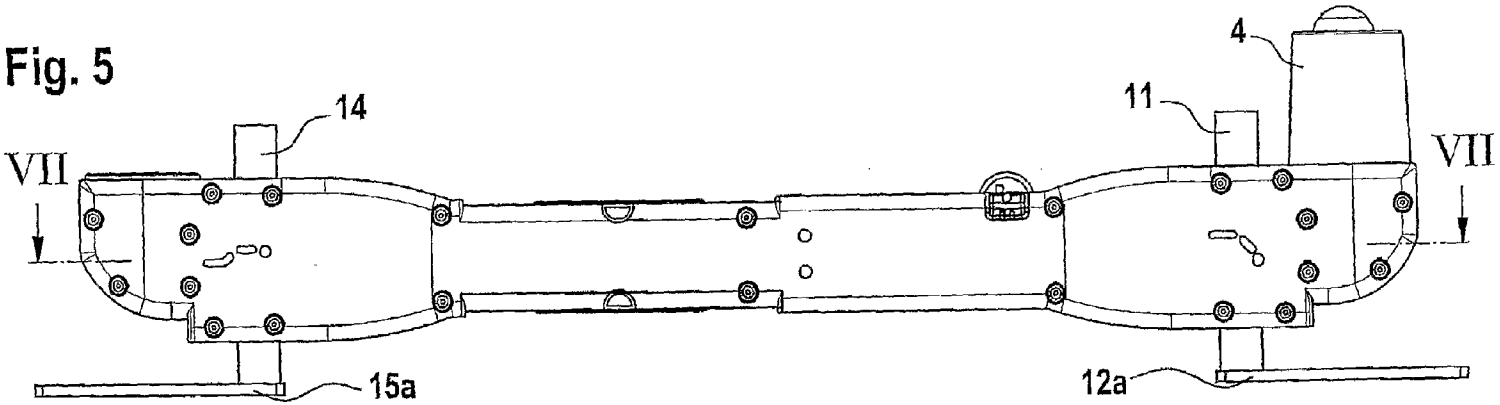
FIG. 5 shows an embodiment of the actuator, seen from the side.
Figure 6:
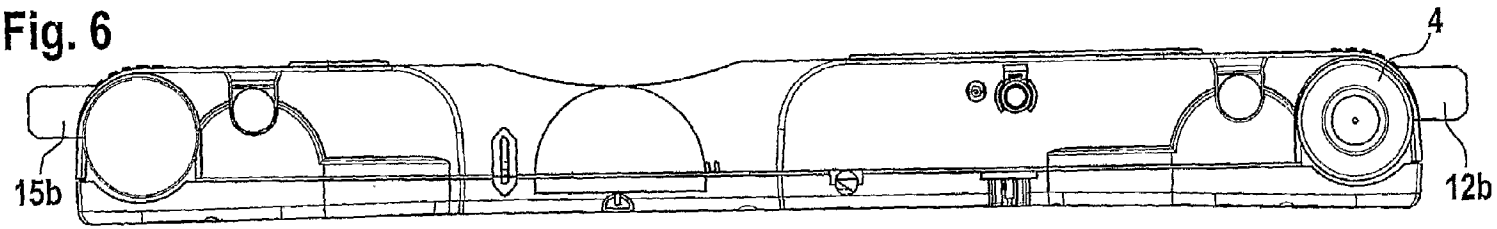
FIG. 6 shows the actuator of FIG. 5, seen from the side.
Figure 7:
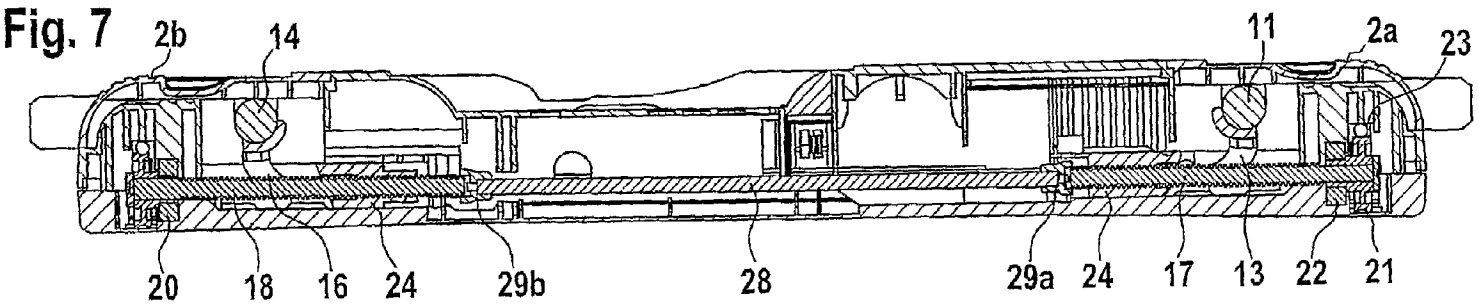
FIG. 7 shows a longitudinal section through the actuator as seen along line VII-VII of FIG. 5.

FIGS. 5-7 of the drawings show a more concrete embodiment of the actuator, where the two spindles are connected with a rod 28 with a coupling member 29*a*, 29*b*. Otherwise, the same reference numerals for the same parts are used as in the foregoing.

In the foregoing, an embodiment of the actuator is described where the actuator is intended to be hooked from below on to the rotary shaft of the sections. However, the actuator may also be configured such that it is arranged from above down over the rotary shafts according to the same principle as is described in WO 03/045195 A1 to Cimosys Limited.

The invention thus provides a simplified structure where it is also possible to use an existing cabinet from actuators having two separate drive mechanisms, where the opening for the second motor housing is just covered by a cover shield. This saves considerable tool costs.

The invention claimed is:

1. An actuator for beds and slatted beds or chairs, comprising a) a cabinet with b) two drive units consisting of bi) a spindle and bii) a spindle nut configured as an adjustment element secured against rotation, wherein one end of the adjustment element is configured for cooperation with an arm of a rotary shaft for a backrest section and a legrest section, respectively, in a bed or a slatted bed in which the actuator is incorporated, c) a reversible electric motor, d) a transmission between the electric motor and the spindle for driving the spindle, wherein e) the spindles are rotationally interconnected and are driven by the common motor.

2. The actuator according to claim 1, wherein the spindles are made in one piece of a rod, and wherein threads are provided on an extent at each end.

3. The actuator according to claim 1, wherein the two spindles are disposed in extension of each other and are interconnected by a pipe member or a rod.

4. The actuator according to claim 1, including tension bearings at one end of the spindle of each driving unit.

5. The actuator according to claim 1, wherein the spindle of the backrest section has a greater pitch than the spindle of the legrest section.

6. The actuator according to claim 5, wherein the spindle of the backrest section has a pitch of the order of 2½ mm, while the spindle of the legrest section has a pitch of the order of 2 mm.

7. The actuator according to claim 1, wherein the spindle nuts can be adjusted such that the backrest section may be raised from a horizontal position to a predetermined angle before the legrest section is activated for raising from its horizontal position.

8. The actuator according to claim 7, wherein the backrest section can be raised to an angular position of the order of 15° before the legrest section is activated.

9. The actuator according to claim 7, wherein the backrest section can be raised to an angular position of the order of 65° and the legrest section to an angular position of the order of 35°.

10. The actuator according to claim 1, wherein the spindle nuts can be adjusted such that the legrest section may be raised from a horizontal position to a predetermined angle before the backrest section is activated for raising from its horizontal position.

11. A combination of a bed, slatted bed or a chair having a backrest section and a legrest section, each with a transverse rotary shaft with an arm, and wherein the sections may be raised and lowered by rotation about their respective shafts, and an actuator according to claim 1 for raising and lowering the backrest and legrest sections, said spindle nuts cooperating with the arm of respective rotary shafts.

* * * * *